US007419007B2

(12) United States Patent
Belcher et al.

(10) Patent No.: US 7,419,007 B2
(45) Date of Patent: Sep. 2, 2008

(54) RETRIEVABLE DOWNHOLE PUMPING SYSTEM

(75) Inventors: Iain R. Belcher, Houston, TX (US); Michael J. Guidry, Jr., Hockley, TX (US); Scott Alan Kruppa, Conroe, TX (US); Jason Clay Kollatschny, The Woodlands, TX (US)

(73) Assignee: Robbins & Myers Energy Systems, L.P., Willis, TX (US)

( * ) Notice: Subject to any disclaimer, the term of this patent is extended or adjusted under 35 U.S.C. 154(b) by 220 days.

(21) Appl. No.: 11/248,090

(22) Filed: Oct. 12, 2005

(65) Prior Publication Data

US 2007/0079970 A1 Apr. 12, 2007

(51) Int. Cl.
*E21B 43/00* (2006.01)

(52) U.S. Cl. ..... 166/369; 166/377; 166/68.5; 166/105; 417/360

(58) Field of Classification Search ..... 166/369, 166/370, 68, 68.5, 105, 377; 417/360, 450
See application file for complete search history.

(56) References Cited

U.S. PATENT DOCUMENTS 4,957,161 A * 9/1990 Cholet et al. ..... 166/105
5,143,153 A 9/1992 Bach et al.
5,871,051 A 2/1999 Mann
5,954,483 A 9/1999 Tetzlaff
6,089,832 A 7/2000 Patterson
6,675,902 B2 1/2004 Rowan et al.
6,695,060 B1 2/2004 Guidry, Jr. et al.
6,881,045 B2 4/2005 Zitka et al.
6,981,045 B1 12/2005 Brooks
2003/0111221 A1 6/2003 Hill et al.

* cited by examiner

*Primary Examiner*—Jennifer H Gay
*Assistant Examiner*—David Andrews
(74) *Attorney, Agent, or Firm*—Browning Bushman P.C.

(57) ABSTRACT

A pumping system 10 is provided for pumping fluid from a downhole well to the surface through a production tubing string well. A rotatable drive rod 18 extends from the surface to power the downhole pump, and includes a plurality of rod couplings. The downhole pump includes a pump stator 22 and a rotor 24 rotatable within the pump stator. A lifting member 36 provided at the upper end of the stator is engaged by a drive coupling 34 to retrieve the pump from the well. The lifting member has an internal shoulder 44 tapered radially inwardly and upwardly, such that a rod coupling engages the internal shoulder and passes through the lifting member as the rotor is pulled upward.

16 Claims, 6 Drawing Sheets

RETRIEVABLE DOWNHOLE PUMPING SYSTEM

FIELD OF THE INVENTION

The present invention relates to a downhole pumping system used to pump liquids, such as oil, from a well to the surface through a production tubing string. More particularly, this invention relates to a retrievable pumping system which allows for the installation and retrieval of a downhole pump without requiring the removal of the production tubing string from the well, and also allows for the disengagement of the rotor from the downhole stator housing for intermittently cleaning the pump.

BACKGROUND OF THE INVENTION

Progressive cavity pumps have been used for decades to pump fluids from an oil well to the surface through a production tubing string. A progressive cavity pump is conventionally powered by a rotating sucker rod string positioned within the tubing string.

It is periodically desirable to retrieve a downhole pump to the surface for inspection and/or repair. As a practical matter, it is highly preferred to retrieve the downhole pump without requiring the retrieval of the tubing string. Many operations also allow sand or other soil material from the formation to enter the interior of the pump, thereby adversely affecting pumping efficiency. In a flushing operation, the rotor may be axially pulled from the stator housing, the interior of the housing flushed to remove the sand or other debris, then the rotor reinserted into the housing to continue pumping operations.

An existing downhole pumping system includes a drive coupling at the upper end of the rotor which may engage a lifting nut to disengage a pump from a landing nipple and retrieve the pump to the surface. A flat shoulder on the lifting nut may thus engage a similar flat surface at the upper end of the drive coupling. The drive coupling outer diameter is larger than the lifting nut internal diameter, such that when the two components engage during pump retrievable, the pump housing is unseated from the landing nipple and retrieved to the surface.

In order to conduct a "flush by" operation, the rotor is axially pulled from the stator and flushed with clean fluid. During this pulling operation, the pump stator should remain seated in the landing nipple, however the drive coupling may engage the lifting nut and unseat the entire pump. One existing solution is to add an extension between the top of the stator and the lifting nut which is sufficiently long to allow the rotor to be pulled out of the stator before engaging the lifting nut. Sucker rods typically have a maximum length of 30 feet, and if the pump length is less than 30 feet, adding such an extension may allow the rotor to be pulled out of the stator before engaging the lifting nut. This solution increases the length of the pumping system, but may work in cases where an extension tube is less than 30 feet in length to allow flush by to be performed. For other applications, an extension greater than 30 feet is not a practical solution to the problem because a sucker rod coupling positioned along the length of this 30 feet extension may engage the inside diameter of the lifting nut and still inadvertently unseat the pump. One possibility is a single-length sucker rod which has a length of 50 feet or more without a coupling, but this solution would be expensive. It would also be difficult to transport such a special sucker rod, and would require a full size workover rig to perform a flush by operation. The cost of a single 50 foot long sucker rod may thus be prohibitive.

A progressive cavity pump with a retrievable rotor is disclosed in U.S. Pat. No. 5,988,992. A retrievable electric pump is disclosed in U.S. Pat. No. 5,954,483. U.S. Pat. No. 6,675,902 discloses a type of progressive cavity pump, and U.S. Pat. No. 6,089,832 discloses a retrievable electric motor pump. U.S. Pat. No. 5,871,051 discloses a retrievable rotary pump, and U.S. Pat. No. 6,695,060 discloses another type of retrievable progressive cavity pump. Improved pump construction is disclosed in U.S. Pat. No. 6,981,045.

The disadvantages of the prior art are overcome by the present invention, and an improved pumping system for retrieving a downhole pump is hereinafter disclosed, wherein a pumping system allows the rotor to be pulled from the stator for reliably performing a flushing operation.

SUMMARY OF THE INVENTION

In one embodiment, a pumping system for pumping fluid from a downhole well to the surface through a production tubing string uses a downhole pump retrievable to the surface without retrieving the production tubing string. The system includes a landing nipple positioned at a lower end of the production tubing string, and a rotatable drive rod extending from the surface to power the downhole pump, with the drive rod including a plurality of rod couplings. The downhole pump includes a pump stator and a rotor rotatable within the pump stator along a pump axis to pump fluid. A connector releasably connects the pump housing to the landing nipple, and a drive coupling interconnects the drive rod with the rotor. A lifting member supported on the pump housing is provided to retrieve the pump from the well, with the lifting member having an internal shoulder tapered radially inwardly and upwardly relative to the pump axis, such that a rod coupling above the drive coupling and below the internal shoulder engages the internal shoulder as the rotor is pulled upward to pass the rod coupling above the lifting member.

In another embodiment, a pumping system for pumping fluid from the downhole well to the surface through a production tubing string uses a downhole pump retrievable to the surface without retrieving the production tubing string, and includes a rotatable drive rod extending from the surface to power the downhole pump, with a drive rod including a plurality of rod couplings. The downhole pump includes a pump stator and a rotor rotatable within the pump stator along a pump axis to pump fluid. A drive coupling connects the drive rod with the rotor, and a lifting member supported on the pump housing is engaged by the drive coupling to retrieve the pump from the well. The lifting member is threaded to the stator and has an internal shoulder tapered radially inwardly and upwardly from 120° to 170° relative to the pump axis, such that a rod coupling above the drive coupling and below the internal shoulder engages the internal shoulder as the rotor is pulled upward to pass the rod coupling above the lifting member.

A method of retrieving a downhole pump to the surface includes positioning a landing nipple at the lower end of the production tubing string, and extending a rotatable drive rod from the surface to power the downhole pump, with the drive rod including a plurality of rod couplings. The downhole pump includes a pump stator and a rotor rotatable within the pump stator along a pump axis to pump fluid. The method includes releasably connecting the pump housing and the landing nipple, and interconnecting the drive rod and the rotor with a drive coupling. The method further includes supporting a lifting member on the pump housing for engagement with the drive coupling to retrieve the pump from the well, and forming an internal shoulder on the lifting member tapered radially inwardly and upwardly relative to the pump axis, such that a rod coupling above the drive coupling and below the internal shoulder engages the internal shoulder as the rotor is pulled upward to pass the rod coupling above a lifting member.

These and further features and advantages of the present invention will become apparent from the following detailed description, wherein reference is made to the figures in the accompanying drawings.

DETAILED DESCRIPTION OF PREFERRED EMBODIMENTS

Figure 1:
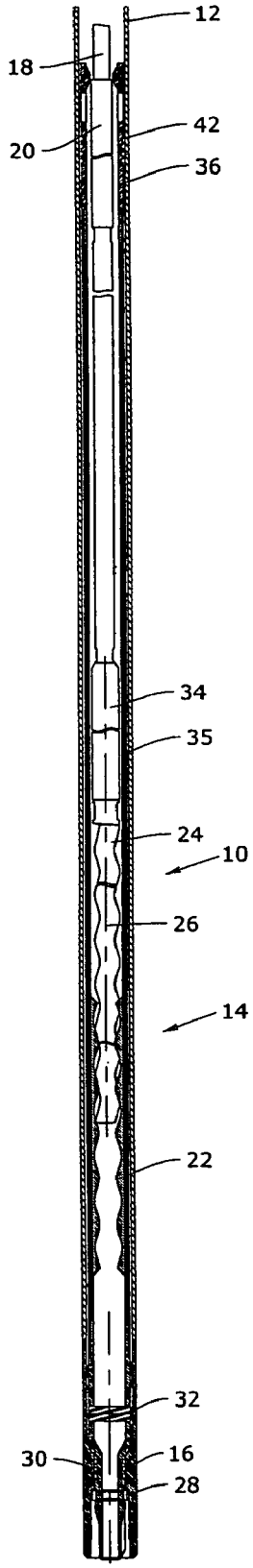
FIG. 1 is a cross-sectional view of a portion of the pumping system, showing a coupling along a sucker rod engaging a lifting nut.

FIG. 1 illustrates a portion of a pumping system 10 according to one embodiment of the invention for pumping fluid from a downhole well to the surface through a production tubing string 12 using a downhole pump 14 which is retrievable to the surface without retrieving the production tubing string. A landing nipple 16 is provided at the lower end of the production tubing string 12, and a rotatable drive rod 18, which is commonly referred to as sucker rod, extends from the surface to power the downhole pump. Those skilled in the art appreciate that the drive rod includes a plurality of conventional couplings 20 along the length of the drive rod, since the drive rod is typically provided in lengths of approximately 30 feet and is connected to form a sucker rod string with couplings threadably connecting one end of a sucker rod to an end of an adjoining sucker rod. Those skilled in the art also appreciate that the downhole pump 14 shown in FIG. 1 is a progressive cavity pump, and includes a pump housing or stator 22 with an elastomeric layer therein, and a pump rotor 24 which rotates within the pump stator along a pump axis 26 to pump fluid.

As shown in FIG. 1, a pump stator is landed on the landing nipple 16, and a releasable connector 28, which may be a C ring, releasably interconnects the pump stator to the landing nipple. A plurality of seals 30 are provided between an outer surface of the releasable connector secured to the pump stator and an interior surface of the landing nipple, with a stop 32 limiting downward movement of the rotor 24 with respect to the pump housing 22 during installation and setting of the rotor.

A drive coupling 34 is provided for interconnecting the drive rod 18 and the rotor 24, and has a diameter greater than the diameter of either the drive rod 18 or the couplings 20 which interconnect lengths of the drive rod. A lifting member 36 is supported at the upper end of the pump housing, and as explained subsequently, is engaged by the drive coupling 34 to retrieve the pump from the well.

Figure 2:
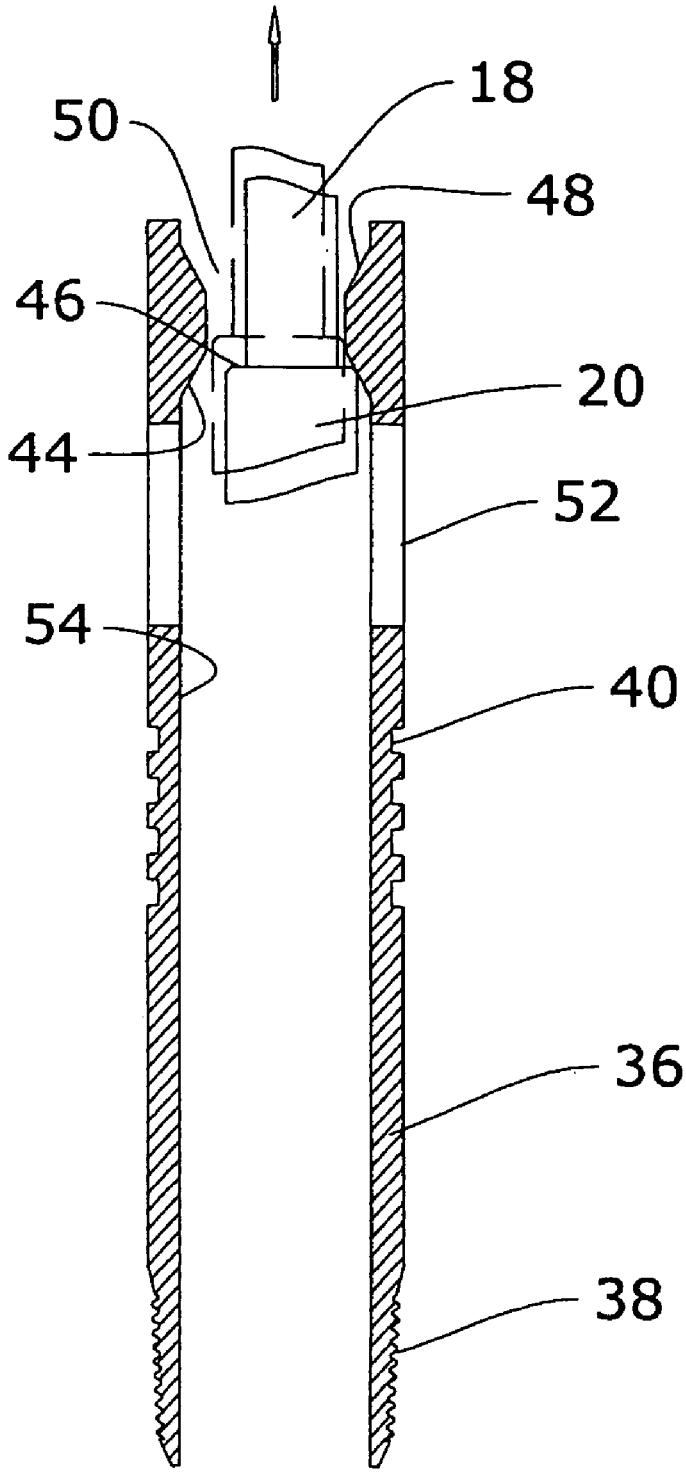
FIG. 2 is an enlarged cross-sectional view of a portion of the pumping system shown in FIG. 1, showing the sucker rod coupling in greater detail in solid lines engaging the lifting nut, and in dashed lines showing the sucker rod coupling centered for passing through an internal bore of the lifting member to be raised above the lifting member.

FIG. 2 depicts in greater detail the lifting member 36 shown in FIG. 1. The lower end of the lifting member includes conventional threads 38 for threaded engagement with the pump stator or with an extension tube 35 secured to the pump stator, and a plurality of annular recesses 40 are provided in the lifting member for receiving O-rings or other sealing members 42, as shown in FIG. 1, which seal between the lifting member and the production tubing string 12. Since the lifting member conventionally may be threaded to the pump stator, it is frequently referred to as a lifting nut. According to the present invention, the lifting member has an internal shoulder 44 which is tapered radially inwardly and upwardly relative to the pump axis, such that a rod coupling 20 above the drive coupling 34 and below the internal shoulder engages the internal shoulder as the rotor 24 is pulled upward to pass the rod coupling 20 above the lifting member. Those skilled in the art appreciate that the rod coupling 20 conventionally includes an upper surface 46 and a similar lower surface which are each substantially perpendicular to the pump axis, although the outward edges of these shoulders may be rounded. As explained subsequently, the lifting member further includes an upper shoulder 48 which is tapered radially inwardly and downwardly relative to the pump axis, so that a rod coupling above the lifting member will engage the upper shoulder and move into the bore 50 of the lifting member as a rotor is lowered toward the landing nipple. The lifting member 36 also includes one or more ports 52 in fluid communication between the interior of the stator and the production tubing string. During operation of the pump, flow is thus allowed through the clearance between the drive rod 18 and the lifting nut 36, and also between the interior of the pump housing and the production tubing string above the seals 42 through the ports 52.

As shown in FIG. 2, the internal surface 44 of the lifting member 36 is tapered from substantially an internal surface 54 of the lifting member below the shoulder 44 to substantially the internal bore 50 of the lifting member. In a preferred embodiment, the taper 44 on a lifting member is at an angle of from about 120° to about 170° relative to the axis of the pump, so that when the drive coupling 20 engages the shoulder 44, the upward force supplied to the drive rod exerts a considerable radial force to the coupling 20 to center the coupling within the bore 50 in the lifting member. This prevents the coupling 20 from getting "hung up" on a shoulder of the lifting member perpendicular to the axis of the pump, thereby significantly increasing the reliability of the pump retrieval operation. The coupling 20 may also be passed above the tapered shoulder 44 when the rotor is pulled above the stator for a flushing operation that does not involve retrieval of the pump.

Figure 3:
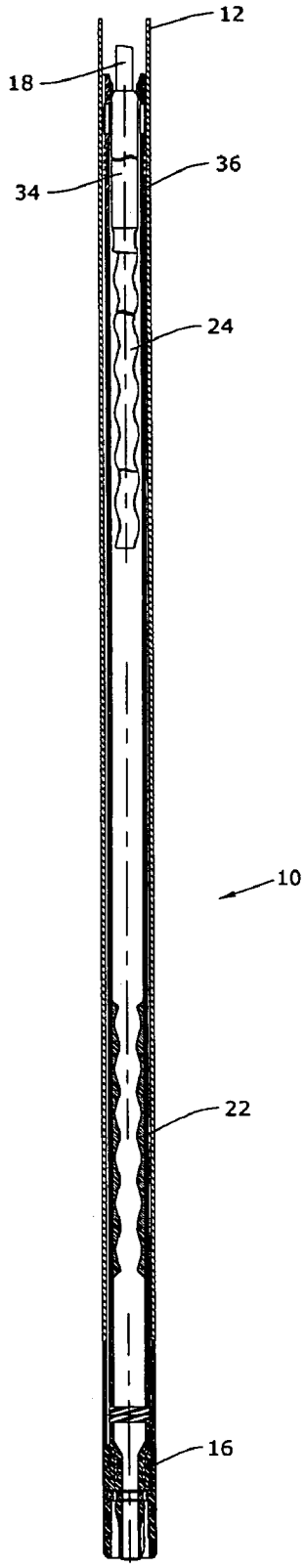
FIG. 3 is a cross-sectional view illustrating a portion of the pumping system with a drive coupling engaging the lifting member.
Figure 4:
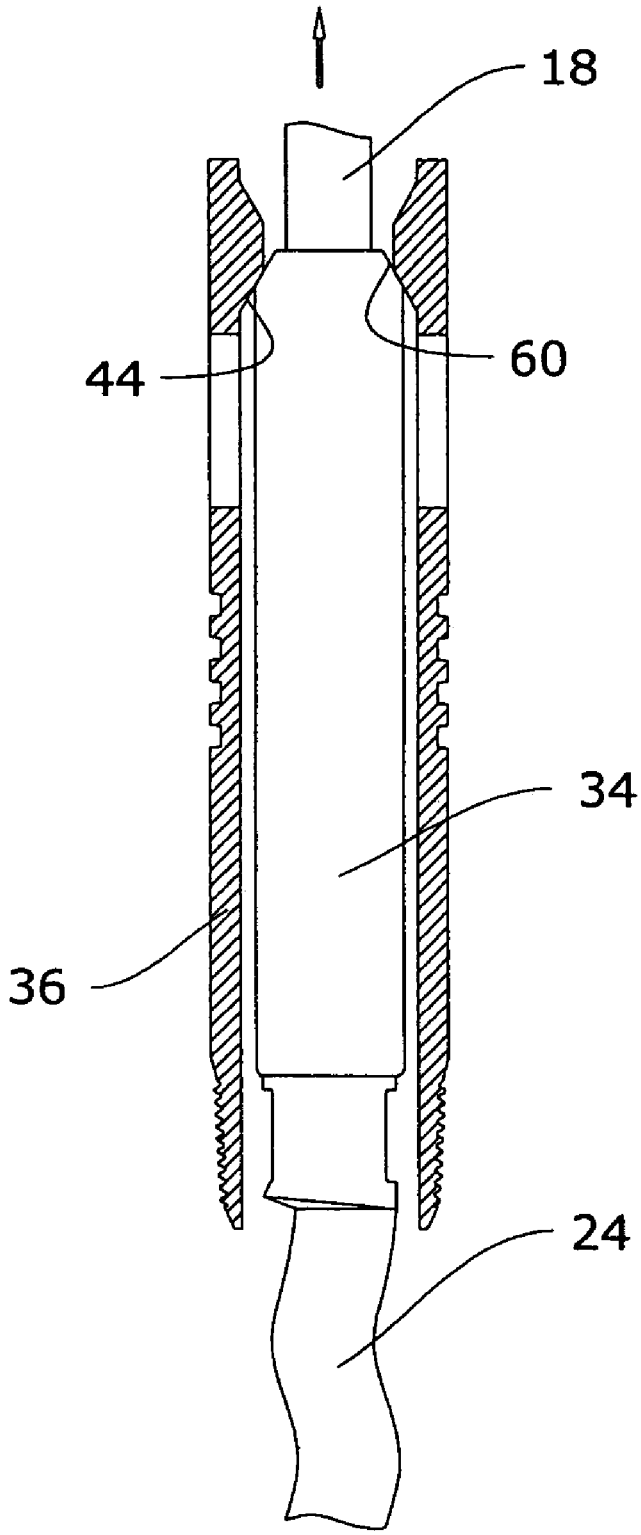
FIG. 4 is an enlarged cross-sectional view illustrating the lifting member shown in FIG. 3 with the drive coupling engaging the lifting member.

Referring now to FIG. 3, the pumping system 10 is shown with the stator 22 still landed in the landing nipple 16, although the rotor 24 has been lifted upward by the drive rod 18 until the drive coupling 34 engages the surface 44 at the upper end of the lifting member 36. The drive coupling 34 thus has a diameter greater than the diameter of the bore 50 in the lifting member 36, so the drive coupling cannot be pulled upward past the landing nipple. Preferably the upper end of the drive coupling 34 has an upper shoulder 60 as shown in FIG. 4 which has a taper substantially mating with the taper 44 on a lifting member, so that when these tapers engage, a substantial pulling force may be applied to the drive rod 18, then to the lifting member 36 and the housing 22 to separate the pump housing 22 from the landing nipple 16, which will remain in the well. Taper 60 in a preferred embodiment is thus substantially equal to the taper of the internal shoulder 44 of the lifting member. Any sucker rod couplings positioned below the lifting shoulder 44 when the pump is operating thus first pass upward through the bore in the lifting member, thereby allowing the drive coupling 34 to engage the lifting member and exert the substantial pulling force desired to release the pump housing 22 from the landing nipple, so that the pump including the rotor 24 and the stator 22 may be pulled to the surface of the well with the drive rod 18.

Figure 5:
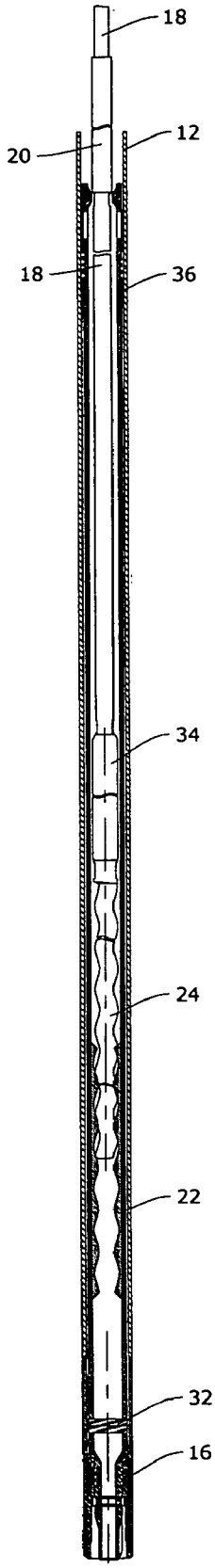
FIG. 5 is a cross-sectional view of a portion of the pumping system with a sucker rod coupling lowered to engage an upper taper on the lifting member.
Figure 6:
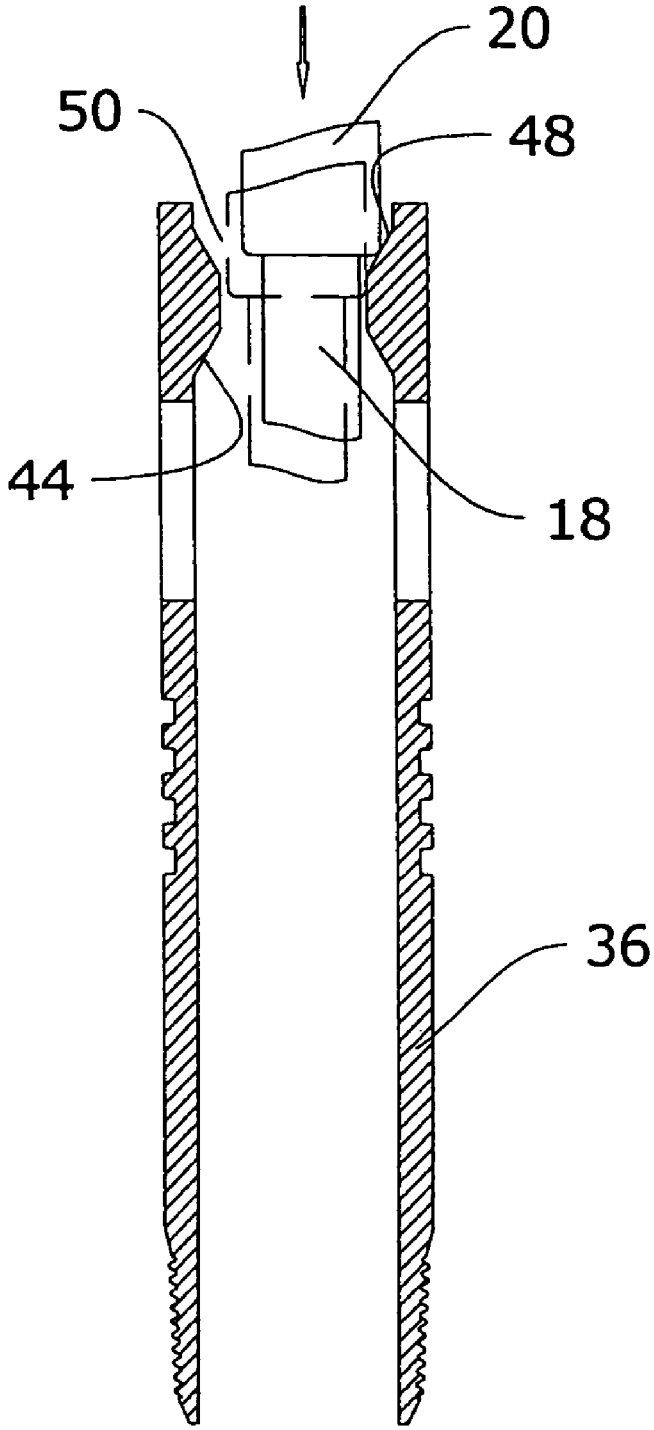
FIG. 6 is an enlarged cross-sectional view illustrating a rod coupling in solid lines engaging the lifting member, and in dashed lines showing the rod coupling centered for passing through the bore and into the interior of the lifting member.

FIG. 5 illustrates the pump housing 22 lowered back into engagement with the landing nipple 16. When the pump rotor and stator are lowered back into the well, the drive coupling 34 will inherently be below the tapered surface 44 on the landing nipple. FIG. 5 also illustrates a coupling 20 at the lower end of a drive rod 18 engaging the upper end of the lifting member 36, with the lower end of the coupling 20 engaging the upper tapered surface 48, as shown more clearly in FIG. 6. Since the surface 48 also includes a substantial taper, the lower end of a coupling 20 may engage this surface, and continued downward movement of the drive rod 18 will center the coupling 20 to the position shown in dashed lines in FIG. 6, so that the coupling will be centered with respect to the bore 50 in a lifting member and pass downward through a lifting member, until the lower end of the rotor 24 engages or is substantially adjacent the stop 32.

In another embodiment, a landing nipple may not be provided at the lower end of the production tubing string, nor a connector provided for releasably connecting the pump housing and the landing nipple. The pump housing may alternatively be secured within the well by retrievable slips or by other members which engage the interior surface of the production tubing string to secure the pump housing in place. As previously noted, a lifting member may be threaded to the stator and may include an internal shoulder tapered radially inward and upward from 120° to 170° relative to the pump axis.

According to a method of the invention for retrieving a downhole pump to the surface without retrieving the production tubing string, a rotatable drive rod may be extended from the surface to power the downhole pump, with the drive rod including a plurality of rod couplings. The downhole pump as disclosed herein may be a progressive cavity pump which includes a pump stator and a rotor rotatable within the pump stator along a pump axis to pump fluid. The pump housing may be releasably connected to the production tubing string, and the drive rod and the rotor interconnected with a drive coupling. The method includes supporting a lifting member on the pump housing for engagement with the drive coupling to retrieve the pump from the well, and forming an internal shoulder on the lifting member tapered radially inwardly and upwardly relative to the pump axis, such that a rod coupling above the drive coupling and below the internal shoulder engages the internal shoulder as the rotor is pulled upward to pass the rod coupling above the lifting member.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A pumping system for pumping fluid from the downhole well to the surface through a production tubing string using a downhole pump retrievable to the surface without retrieving the production tubing string, the system comprising:

a landing nipple positioned at a lower end of the production tubing string;

a rotatable drive rod extending from the surface to power the downhole pump, the drive rod including a plurality of rod couplings;

the downhole pump including a pump stator and a rotor rotatable within the pump stator along a pump axis to pump fluid;

a connector for releasably connecting the pump housing and the landing nipple;

a drive coupling for interconnecting the drive rod with the rotor;

a lifting member supported on the pump housing for engagement with the drive coupling to retrieve the pump from the well; and the lifting member having an internal shoulder tapered radially inwardly and upwardly relative to the pump axis, an upper shoulder tapered radially inwardly and downwardly relative to the pump axis, and a through-bore radially inward of the internal shoulder for passing a rod coupling from below to above the lifting member, such that the rod coupling above the drive coupling and below the internal shoulder engages the internal shoulder as the rotor is pulled upward to pass the rod coupling above the lifting member and raise the pump rotor above the pump stator, and a rod coupling above the lifting member engages the upper shoulder as the rotor is lowered toward the landing nipple.

2. A pumping system as defined in claim 1, wherein the drive coupling has an upper shoulder extending radially inwardly and downwardly from the drive rod for engaging the internal surface on the lifting member to retrieve the pump from the well.

3. A pumping system as defined in claim 2, wherein the upper shoulder on the drive coupling has a taper substantially equal to the taper of the internal shoulder on the lifting member.

4. A pumping system as defined in claim 1, wherein the connector includes a snap ring.

5. A pumping system as defined in claim 1, further comprising:

one or more upper seals between the lifting member and the production tubing string; and one or more lower seals between a releasable connector secured to the pump housing and the landing nipple.

6. A pumping system as defined in claim 1, wherein the lifting member is a nut threaded to one of the pump housing and an extension tube secured to the pump housing.

7. A pumping system as defined in claim 1, wherein the taper of the internal shoulder on the lifting member extends from substantially an internal surface of the lifting member below the shoulder to substantially an internal bore of the lifting member.

8. A pumping system as defined in claim 1, wherein the taper of the internal shoulder on the lifting member is from 120° to 170° relative to the axis of the pump.

9. A pumping system for pumping fluid from the downhole well to the surface through a production tubing string using a downhole pump retrievable to the surface without retrieving the production tubing string, the system comprising:

a rotatable drive rod extending from the surface to power the downhole pump, the drive rod including a plurality of rod couplings;

the downhole pump including a pump stator and a rotor rotatable within the pump stator along a pump axis to pump fluid;

a drive coupling for interconnecting the drive rod with the rotor;

a lifting member supported on one of the pump stator and an extension tube secured to the pump stator for engagement with the drive coupling to retrieve the pump from the well; and the lifting member threaded to one of the pump stator and the extension tube secured to the pump stator and having an internal shoulder tapered radially inwardly and upwardly from 120° to 170° relative to the pump axis, an upper shoulder tapered radially inwardly and downwardly relative to the pump axis, and a throughbore radially inward of the internal shoulder for passing a rod coupling from below to above the lifting member, such that the rod coupling above the drive coupling and below the internal shoulder engages the internal shoulder as the rotor is pulled upward to pass the rod coupling above the lifting member and raise the pump rotor above the pump stator, and a rod coupling above the lifting member may engage and pass through the upper shoulder as the rotor is lowered toward the landing nipple.

10. A pumping system as defined in claim 9, wherein the drive coupling has an upper shoulder extending radially inwardly and downwardly from the drive rod.

11. A pumping system as defined in claim 9, further comprising: one or more upper seals between the lifting member and the production tubing string.

12. A pumping system as defined in claim 9, wherein the taper of the internal shoulder on the lifting member extends from substantially an internal surface of the lifting member below the shoulder to substantially an internal bore of the lifting member.

13. A method of retrieving a downhole pump to the surface, comprising:

extending a rotatable drive rod from the surface to power the downhole pump, the drive rod including a plurality of rod couplings;

the downhole pump including a pump stator and a rotor rotatable within the pump stator along a pump axis;

releasably connecting the pump housing to the production tubing string;

interconnecting the drive rod and the rotor with a drive coupling;

supporting a lifting member on the pump housing for engagement with the drive coupling to retrieve the pump from the well;

forming an internal shoulder on the lifting member tapered radially inwardly and upwardly relative to the pump axis, and a throughbore radially inward of the internal shoulder for passing a rod coupling from below to above the lifting member, such that the rod coupling above the drive coupling and below the internal shoulder engages the internal shoulder as the rotor is pulled upward above the stator to pass the rod coupling through the throughbore and above the lifting member; and forming an upper shoulder on the lifting member tapered radially inwardly and downwardly relative to the pump axis, such that a rod coupling above the lifting member engages the upper shoulder as the rotor is lowered toward the landing nipple.

14. A method as defined in claim 13, wherein the drive coupling is formed with an upper shoulder extending radially outwardly and downwardly from the drive rod.

15. A method as defined in claim 13, further comprising:

providing one or more upper seals between the lifting member and the production tubing string; and providing one or more lower seals between the pump housing and the landing nipple.

16. A method as defined in claim 13, wherein the taper of the internal shoulder on the lifting member is from 120° to 170° relative to the axis of the pump.

* * * * *